US005557382A

United States Patent [19]

Tatsumi et al.

[11] Patent Number: 5,557,382

[45] Date of Patent: Sep. 17, 1996

[54] TONER REPLENISHING DEVICE FOR A DEVELOPING DEVICE

[75] Inventors: Kenzou Tatsumi, Yokohama; Takeshi Saito, Tokyo; Akio Kutsuwada, Kawasaki; Noboru Kusunose, Yokohama; Shigeru Yoshiki, Kawasaki, all of Japan

[73] Assignee: Ricoh Company, Ltd., Tokyo, Japan

[21] Appl. No.: 554,520

[22] Filed: Nov. 7, 1995

[30] Foreign Application Priority Data

| | | | |
|---|---|---|---|
| Nov. 8, 1994 | [JP] | Japan | 6-273440 |
| Apr. 18, 1995 | [JP] | Japan | 7-092815 |
| Aug. 25, 1995 | [JP] | Japan | 7-217694 |

[51] Int. Cl.[6] ..... G03G 15/08

[52] U.S. Cl. ..... 355/260; 222/DIG. 1

[58] Field of Search ..... 355/245, 260; 222/DIG. 1, 189.02; 118/653

[56] References Cited

U.S. PATENT DOCUMENTS

| | | | |
|---|---|---|---|
| 4,967,234 | 10/1990 | Tani et al. | 355/260 |
| 5,054,934 | 10/1991 | Kintz | 222/189.02 X |
| 5,449,095 | 9/1995 | Kobayashi | 222/DIG. 1 X |

FOREIGN PATENT DOCUMENTS

| | | |
|---|---|---|
| 59-102260 | 6/1984 | Japan . |
| 60-158471 | 8/1985 | Japan . |
| 62-14458 | 1/1987 | Japan . |
| 63-101880 | 5/1988 | Japan . |
| 64-38659 | 3/1989 | Japan . |

*Primary Examiner*—Joan H. Pendegrass
*Assistant Examiner*—Sophia S. Chen
*Attorney, Agent, or Firm*—Oblon, Spivak, McClelland, Maier & Neustadt, P.C.

[57] ABSTRACT

In a developing device included in an electrophotographic image forming apparatus, a device for replenishing toner to the developing device has a toner container having a hollow cylindrical body. The body is formed with a toner outlet at the center of one end thereof. A holder arrangement holds the container such that the toner can be delivered to a toner inlet portion included in the developing device. A drive mechanism causes the container to rotate about its own axis. The holder arrangement is formed with an opening for feeding the toner flowing out via the toner outlet to the toner inlet portion. The opening is covered with an elastic member having a holed portion. The device is capable of replenishing a predetermined amount of toner to the developing device at all times.

12 Claims, 16 Drawing Sheets

TONER REPLENISHING DEVICE FOR A DEVELOPING DEVICE

BACKGROUND OF THE INVENTION

The present invention relates to a toner replenishing device to be mounted on a developing device included in an electrophotographic image forming apparatus. More particularly, the present invention is concerned with a device capable of replenishing toner therefrom to the developing section of a developing device by being rotated about its own axis.

It has been customary with an electrophotographic image forming apparatus to replenish toner from a toner replenishing device to a developing device which develops a latent image electrostatically formed on an image carrier. Typically, the developing device has a toner cartridge storing fresh toner therein, and a toner hopper to which the toner is to be fed. An agitator is disposed in the cartridge and drives the toner out of the cartridge into the hopper. However, because the toner is fed from the cartridge to the hopper and then to the developing section in two consecutive steps, an exclusive space must be allocated to each of the cartridge and hopper. This, coupled with the fact that a particular driveline must be associated with each of the agitator and a toner supply roller, increases the size and cost of the replenishing device.

SUMMARY OF THE INVENTION

It is, therefore, an object of the present invention to provide a device capable of replenishing a predetermined amount of toner to a developing device at all times with an inexpensive, compact and simple configuration.

In accordance with the present invention, a device for replenishing toner to a developing section included in a developing device, and removably mounted to the developing device has a toner storing section accommodating an agitator, and formed with an opening at one end portion with respect to the widthwise direction of the developing device. An elastic member covers the opening and is formed with a holed portion for replenishing the toner driven by the agitator from the toner storing section to the developing section. A mechanism is provided for closing the holed portion when the device is to be removed from the developing device.

Also, in accordance with the present invention, a device for replenishing toner to a developing section included in a developing device has a toner container comprising a hollow cylindrical body formed with a toner outlet at the center of one end thereof. A holding arrangement holds the toner container in a substantially horizontal position such that the toner is capable of being fed from the toner outlet to a toner inlet portion of the developing device. A drive mechanism causes the toner container held by the holding arrangement to rotate about the axis of the hollow cylindrical body. The holding arrangement is formed with an opening for delivering the toner flowing out of the toner container via the toner outlet to the toner inlet portion. An elastic member having a holed portion covers the opening.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 20:
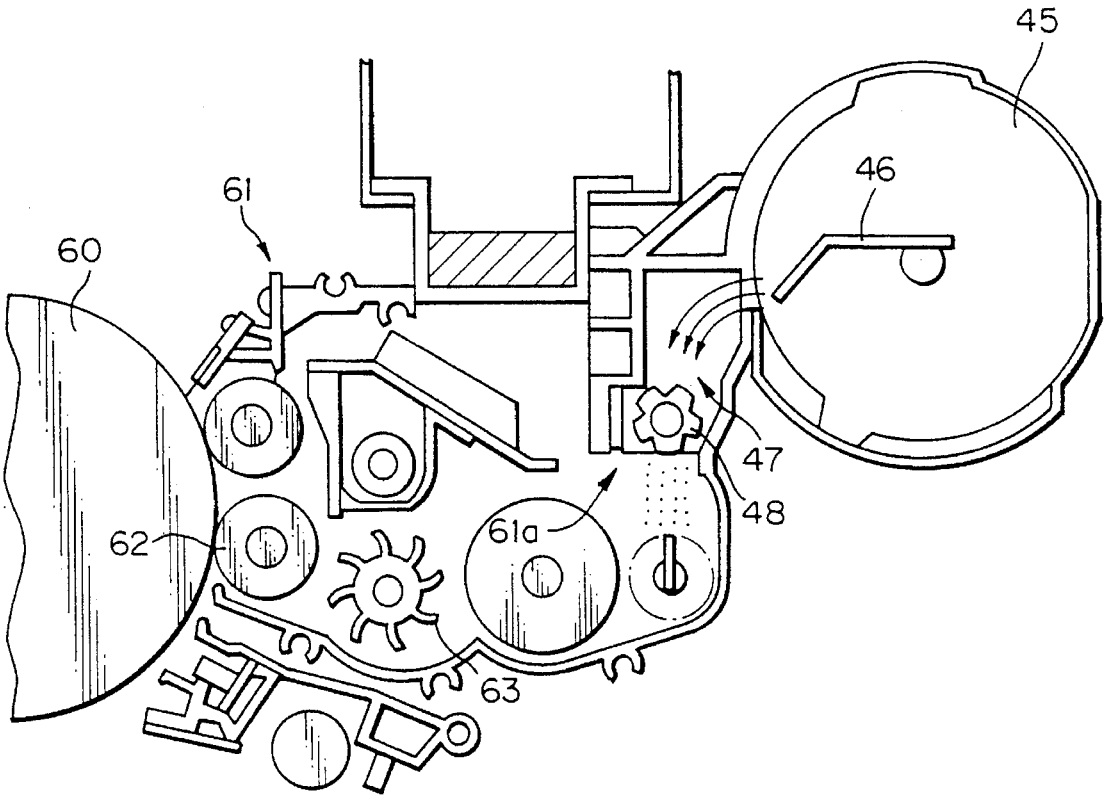
Fig. 20 PRIOR ART
FIG. 20 is a section showing a conventional toner replenishing device.

To better understand the present invention, a brief reference will be made to a typical conventional toner replenishing device, shown in FIG. 20. There are shown in the figure a photoconductive drum 60, a developing device or unit 61, a developing roller 62, and a paddle roller 63. The developing unit 61 has a hopper 47. A toner cartridge 45 storing fresh toner is removably mounted to the developing unit 61 and accommodates an agitator 46 therein. The agitator 46 replenishes the .toner from the toner cartridge 45 into the hopper 47. That is, the toner is not directly fed to a developing section 61*a* included in the unit 61, but it is once fed to the hopper 47. This is because the amount of toner replenishment into the developing section 61*a* by a supply roller 48 should be constant as far as possible in order to maintain the toner concentration in the section 61*a* constant.

However, the above conventional toner replenishing device is bulky and increases the cost, as discussed earlier. Specifically, because the toner is fed from the cartridge 45 to the hopper 47 and then to the developing section 61*a* in two consecutive steps, an exclusive space must be allocated to each of the cartridge 45 and hopper 47. This, coupled with the fact that a particular driveline must be associated with each of the agitator 46 and supply roller 48, increases the size and cost of the replenishing device.

Figure 1A:
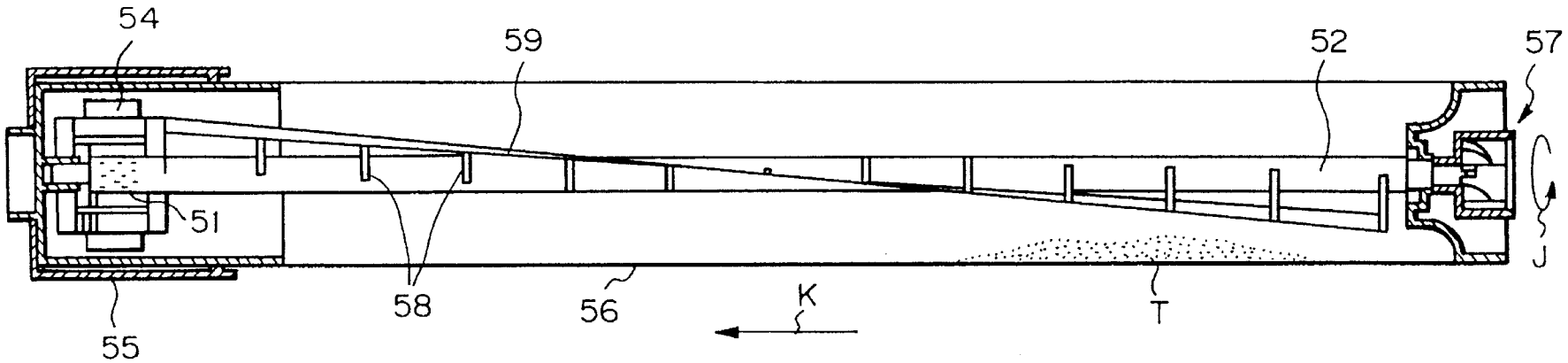
FIG. 1A is a fragmentary section showing a toner replenishing device embodying the present invention.
Figure 1C:
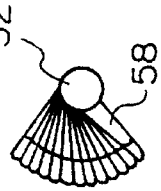
FIG. 1C is a view of an agitator included in the embodiment.
Figure 1B:
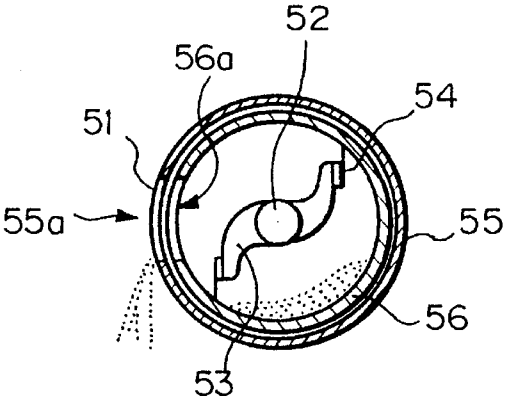
FIG. 1B is a sectional front view of the embodiment.
Figure 2:
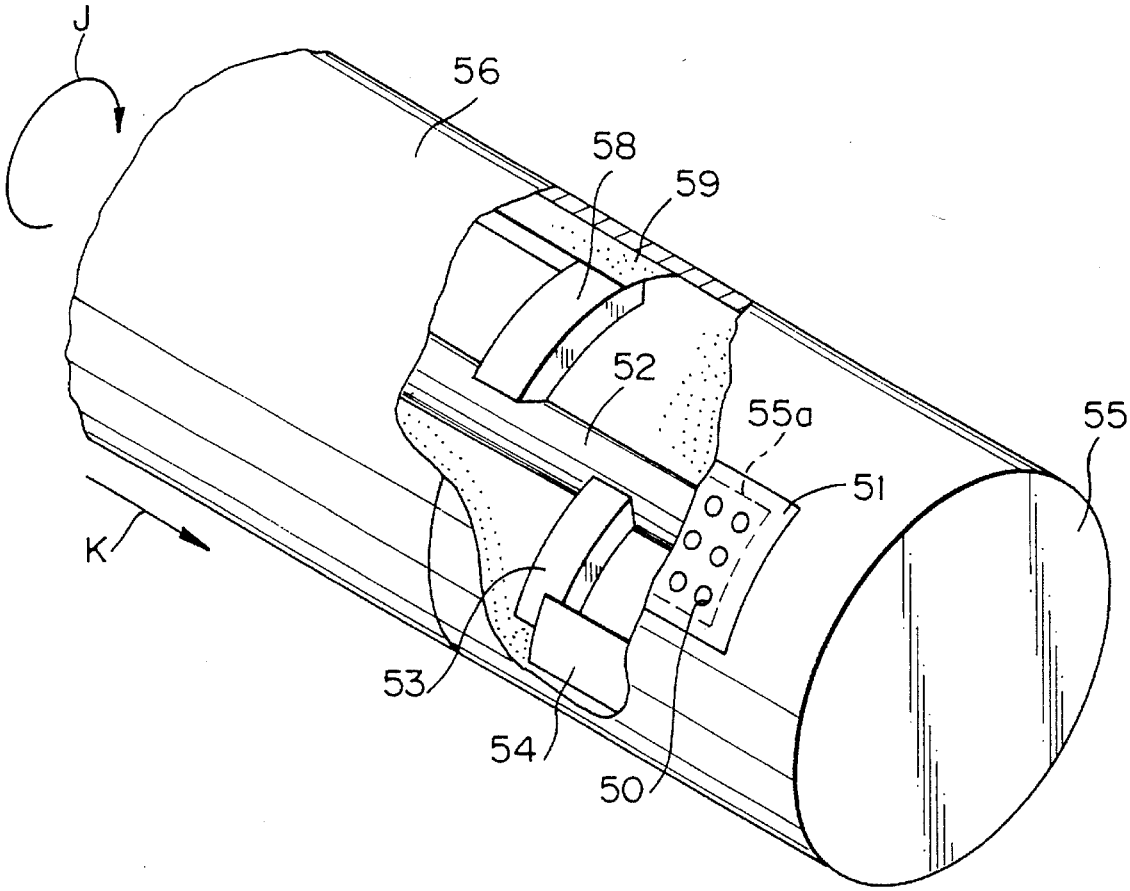
FIG. 2 is a partly taken away fragmentary perspective view of the embodiment.

Referring to FIGS. 1A–1C, a toner replenishing device embodying the present invention is shown and has a hollow cylindrical toner case 56 storing fresh toner T therein. A case 55 is coupled over one end of the toner case or toner storing section 56. A shaft 52 is rotatably disposed in the toner case 56. A joint 57 is connected to one end of the shaft 52, i.e., the right end as viewed in FIG. 1A. A drive mechanism, not shown, causes the shaft 52 to rotate in a direction indicated by an arrow J in FIG. 1A. A plurality of agitators 58 are mounted on the shaft 52. As shown in FIG. 1C, the agitators 58 are sequentially deviated in position from each other; they are twisted in an angular range of about 90 degrees. An agitator in the form of a MYLAR strip 59 is adhered to the free ends of the agitators 58 and is, therefore, also twisted relative to the shaft 52. When the shaft 52 is rotated, the agitator 59 conveys the toner T from the right to the left, as viewed in FIG. 1A, within the toner case 56. As shown in FIGS. 1B and 2, a rake-out agitator 53 is mounted on the end of the shaft 52 adjoining the case 55. A rake-out member in the form of a MYLAR strip 54 is adhered to the free end of the agitator 53. Both the rake-out member 54 and the agitator 59 are implemented by MYLAR films and held in contact with the inner periphery of the toner case 56 at all times.

The case 55 and toner case 56 are respectively formed with rectangular openings 55*a* and 56*a*. A holed sheet, or elastic member, 51 is also implemented by a MYLAR film and formed with a plurality of apertures 50. The sheet 51 is adhered to the case 55 such that it closes the opening 55*a*. The case 55 and toner case 56 are rotatable relative to each other. When the replenishing device is mounted to a developing unit, not shown, it is locked in position with the openings 55*a* and 56*a* aligning with each other, as shown in FIG. 1B.

When the replenishing device is mounted to the developing unit, a torque is transferred to the shaft 52 via the joint 57 and causes the shaft 52 to rotate. As a result, the agitator 59 drives the toner T toward the case 55 in a direction indicated by an arrow K. In the case 55, the rake-out strip 54 rakes out the toner T via the opening 56*a* and the apertures 50 of the sheet 51. At this instant, the free edge of the rake-out strip 54 is flipped by the step existing between the toner case 56 and the opening 56*a* thereof, so that the toner on the strip 54 is discharged via the apertures 50.

The sheet 51 needs only a small size because the apertures 50 are concentratedly located at one end portion of the replenishing device. When the replenishing device is to be removed from the developing unit, the case 55 and toner case 56 are rotated relative to each other so as to bring the openings 55*a* and 56*a* out of alignment. Specifically, the opening 56*a* of the toner case 56 is closed by the case 55 surrounding the toner case 56. At the same time, the open end of the case 55 in the axial direction is sealed by a seal member provided thereon. In this condition, the replenishing device can be dismounted without the toner T leaking from the toner case 56. In addition, the accuracy of the apertures 50 and the contact condition between the rake-out strip 54 and the apertures 50 do not have to be strict.

It has been customary to arrange the apertures 50 in an array in a direction perpendicular to a direction of sheet feed. This kind of arrangement may be advantageous as to irregularities in an image in the widthwise direction of a sheet. However, so long as the apertures 50 of the embodiment are equivalent to those of the conventional device, the concentrated apertures of the embodiment are capable of replenishing the same amount of toner. Hence, if a sufficient agitating time is allocated to the developing section of the developing unit, the embodiment successfully frees an image from irregularities.

Figure 3:
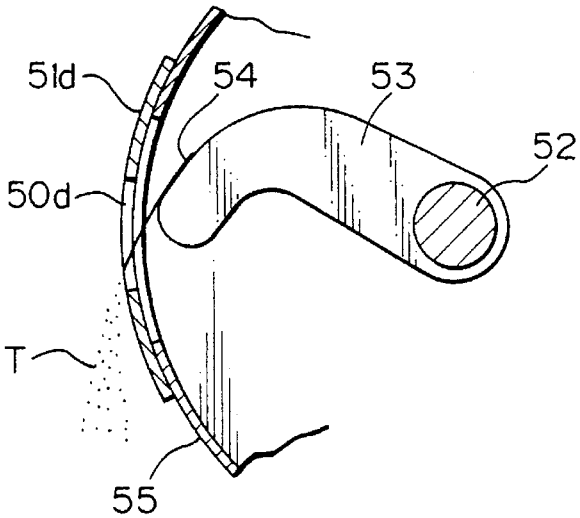
FIG. 3 is a fragmentary section showing a modified form of the embodiment.

As shown in FIG. 3, a sheet of MYLAR 51*d* formed with a slot 50*d* may be substituted for the holed MYLAR sheet 51. The slot 50*d* extends horizontally, i.e., perpendicularly to the direction in which the rake-out MYLAR strip 54 is movable. The slot 50*d* extends over the same length as the opening 55*a* of the case 55 in the axial direction of the case 55. The dimension of the slot 50*d* in the vertical direction, i.e., the direction in which the rake-out strip 54 is movable is selected such that the slot 50*d* has an area equivalent to the total area of the apertures 50. In this modification, the strip 54 is adhered to the agitator 53 in such a manner as to be capable of protruding about 1 mm from the slot 50*d*. When the strip 54 is caused to protrude from the slot 50*d*, it rakes out the toner deposited on the edges of the slot 50*d* and the edges of the opening 55*a*.

Figure 4:
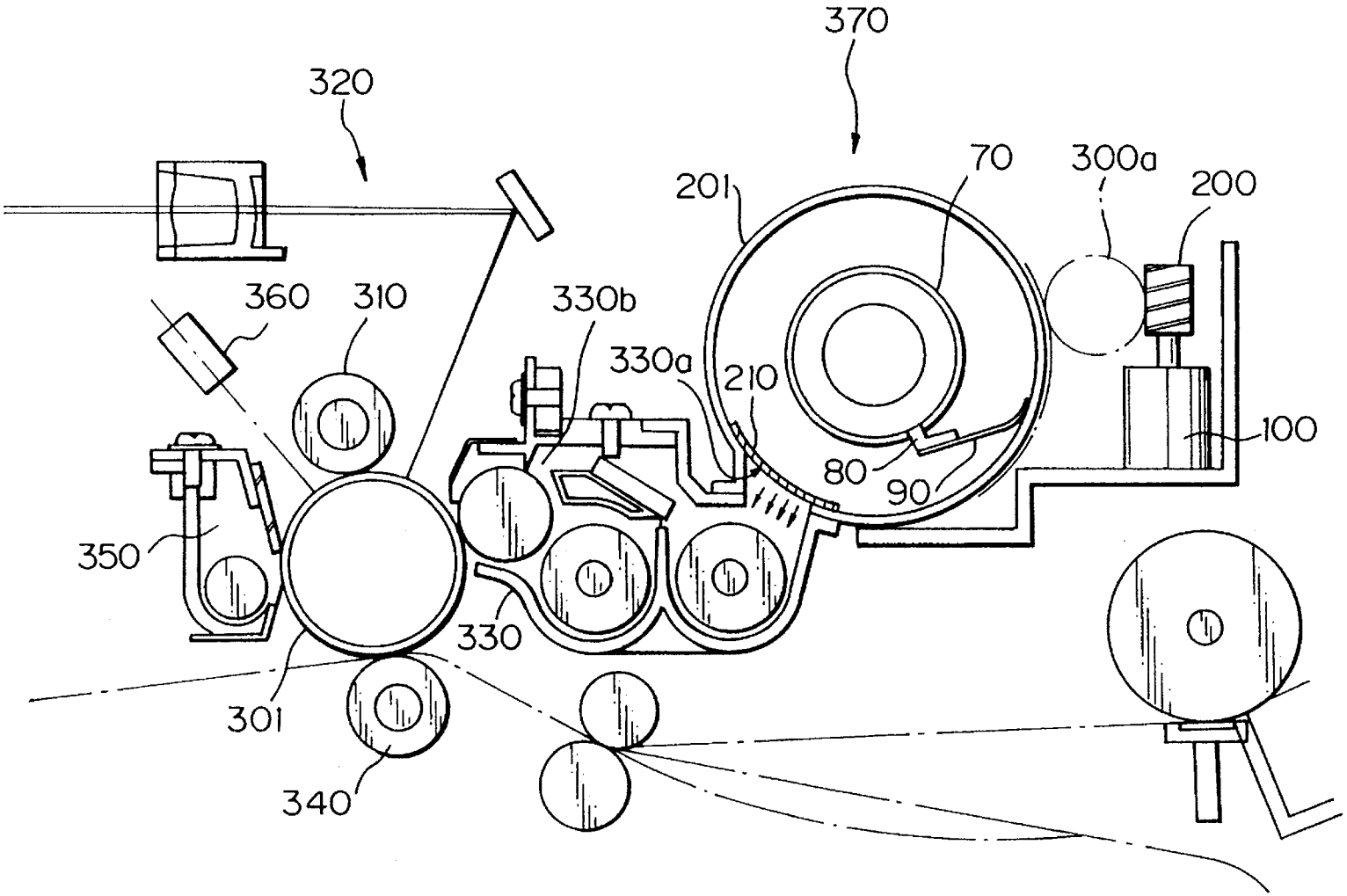
FIG. 4 is a section of an image forming apparatus implemented by an alternative embodiment of the present invention.

FIG. 4 shows an alternative embodiment of the present invention and an image forming apparatus incorporating the embodiment. As shown, the image forming apparatus has a photoconductive drum or image carrier 301. Arranged around the drum 301 are a charge roller 310 for uniformly charging the surface of the drum 301, laser optics or exposing means 320 for electrostatically forming a latent image on the drum 301, a developing device or unit 330 for developing the latent image so as to produce a corresponding toner image, a transfer roller 340 for transferring the toner image to a sheet, a cleaning unit 350 for removing toner remaining on the drum 301 after image transfer, and a discharge lamp 360 for dissipating charge also remaining on the drum 301. The developing unit 330 is provided with a toner replenishing device 370.

Figure 5:
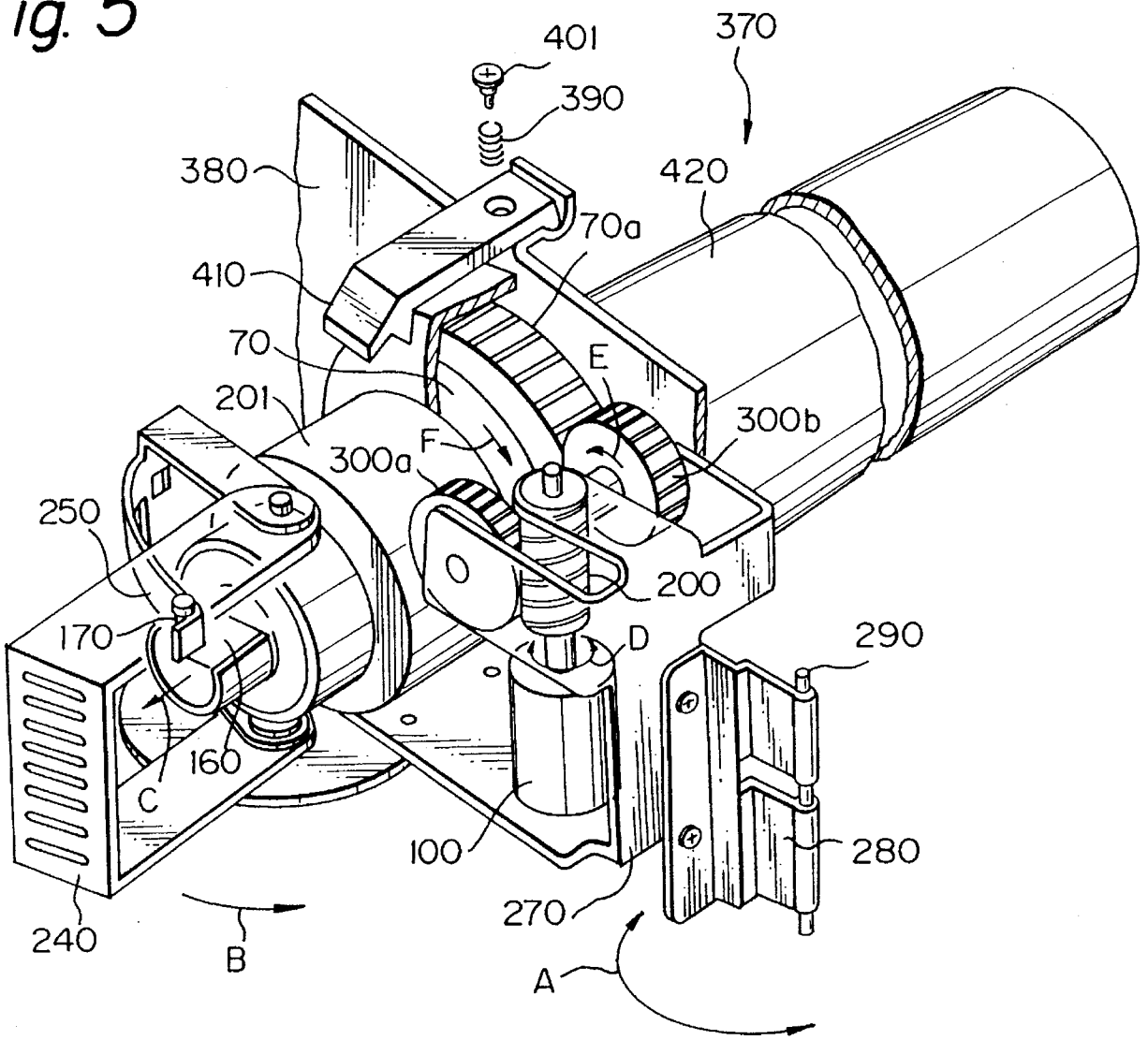
FIG. 5 is a perspective view of an image forming apparatus incorporating another alternative embodiment of the present invention.
Figure 6:
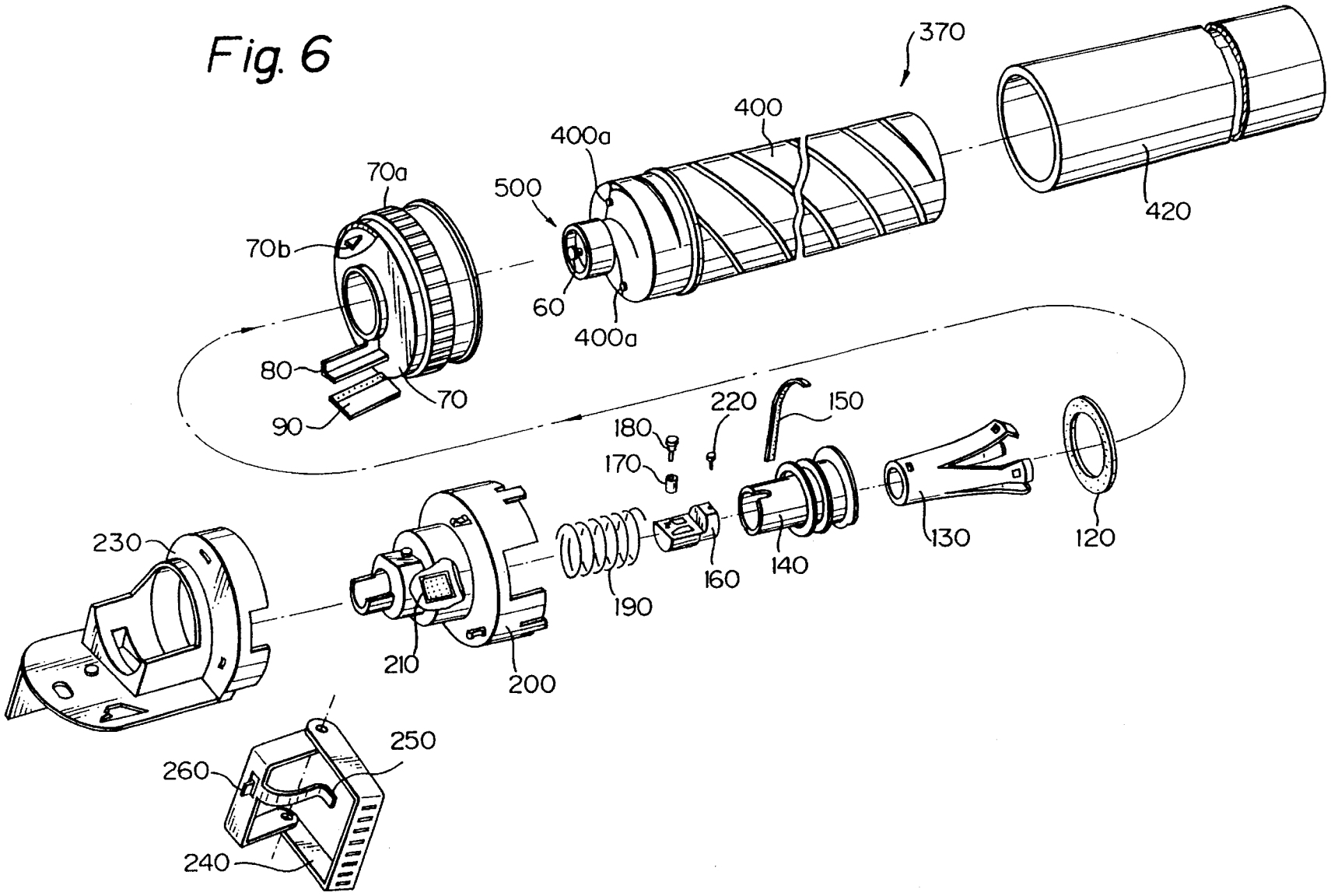
FIG. 6 is an exploded perspective view of constituent parts included in the embodiment of FIG. 5.

As also shown in FIGS. 5 and 6, the replenishing device 370 has a motor 100 and a worm gear 200 mounted on the output shaft of the motor 100. The worm gear 200 is held in mesh with an intermediate gear 300*a*. Another intermediate gear 300*b* is mounted coaxially with the worm gear 200 and held in mesh with a bottle drive gear 70*a* formed on (or affixed to) the outer periphery of a bottle retainer member 70. The bottle retainer member 70 is affixed to a toner container or toner bottle 400 (see FIG. 6). The bottle drive gear 70*a* directly drives the bottle 400 while the retainer member 70 retains the bottle 400.

Figure 7:
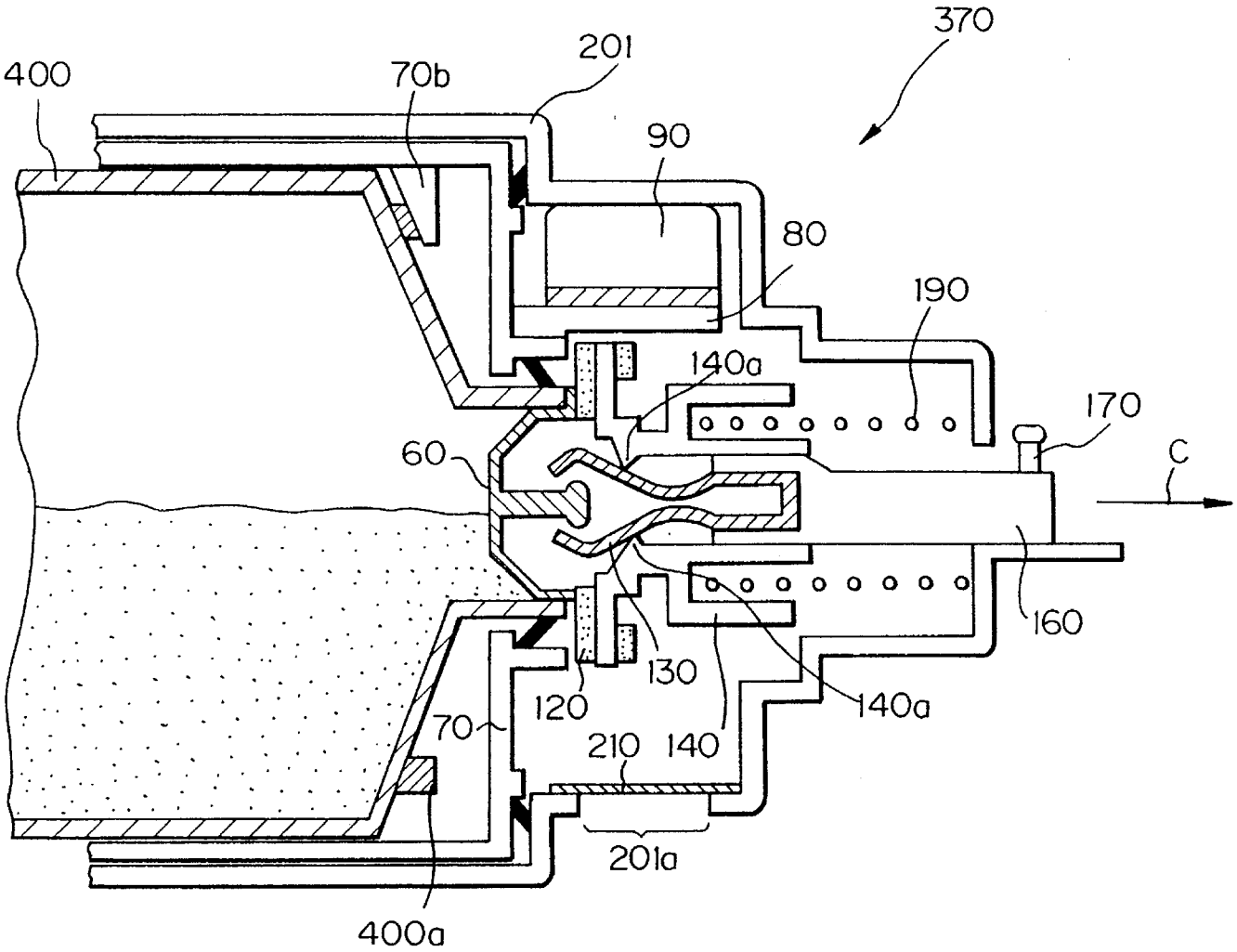
FIG. 7 is a section showing a toner container included in the embodiment of FIG. 5 and mounted to a toner replenishing device.

The motor 100, worm gear 200, intermediate gears 300*a* and 300*b*, and retainer member 70 (particularly the drive gear 70*a*) constitute drive means for causing the bottle 400 to rotate about its own axis. The bottle 400 has a toner outlet or mouth 500 (see FIG. 6) for allowing toner to flow out. A bottle receiver 201 receives or holds the bottle 400 and has an opening 201*a* (see FIG. 7). The opening 201*a* communicates the mouth 500 of the bottle 400 to a toner inlet portion 330*a* formed in the developing unit 330. An elastic member 210 covers the opening 201*a* and formed of MYLAR, rubber or similar elastic material. A plurality of apertures are formed in the elastic member 210. The receiver 201 and the retainer member 70 except for the gear 70*a* thereof constitute holding means for holding the bottle or container 400. Hence, the holding means plays the role of the drive means at the same time. As shown in FIGS. 4, 6 and 7, a rib 80 extends out from the receiver 70. A pusher member 90 is adhered to the rib 80 by, e.g., a two-sided adhesive tape and also implemented by MYLAR, rubber or similar elastic member.

A spiral ridge is formed on the inner periphery of the bottle 400 and causes the toner to flow out via the mouth 500 when the bottle 400 is rotated. As shown in FIGS. 6 and 7, a cap 60 is fitted in the mouth 500 in order to prevent the toner from flowing out. A rib 70*b* is formed on the inner wall of the bottle receiver 70 while lugs 400*a* is formed on the bottle 400. Hence, the receiver 70 and bottle 400 are rotatable integrally with each other with the rib 70*b* catching one of the lugs 400*a*. The reference numerals 120 and 150 designate seal members. A collet chuck 130 selectively grips or releases the cap 60. The chuck 130 is received in a cylindrical case 140 and fastened to a shaft member 160 by a screw 220. A roll 170 is mounted on the shaft member 160 by a stepped screw 180. A coil spring 190 constantly biases the chuck 130, case 140 and shaft member 160 toward the bottle 400. These constituent parts are held by a case 230. An arm 240 is formed integrally with a guide bracket 250 which moves the shaft member 160 in contact with the roll 170. The guide bracket 250 has a stop 260 for stopping the roll 170.

As shown in FIG. 5, the above members except for the bottle 400 (referred to as a bottle drive unit hereinafter) are supported by a bracket 270. A hinge member 280 is rotatable about a shaft 290 which is affixed to an apparatus body, not shown. The bracket 270 is affixed to the hinge member 280. The bottle 400 and the members belonging thereto are accommodated in a sheath 420.

How the bottle 400 is mounted to the apparatus body is as follows. First, the bottle 400 is inserted into the sheath 420. Then, the bottle drive unit is bodily turned about the shaft 290 in a direction A shown in FIG. 5. An arm 410 is affixed to a side panel 380 included in the apparatus body by a spring 390 and a stepped screw 401. The bottle drive unit is affixed by the arm 410. FIG. 7 shows the replenishing device in the above condition.

As shown in FIG. 5, when the arm 240 is turned in a direction B, the guide bracket 250 is brought into contact with the roll 170 and pushes out the roll 170. As a result, the shaft 160 begins to move in a direction C, as also shown in FIG. 7. The shaft 160 causes the collet chuck 130 to abut against an annular lug 140*a* (FIG. 7) formed on the cylindrical case 140. Hence, the chuck 130 begins to close while gripping the cap 60. As the shaft 160 further moves in the direction C, the chuck 130 fully removes the cap 60 from the bottle 400. Consequently, the toner in the bottle 400 flows out onto the bottle receiver 201 (except when the amount of toner in the bottle 400 is small). By the above procedure, the bottle 400 is fully set on the apparatus body. At this instant, the stop 260 remains in abutment against the roll 170. As stated above, after the bottle drive unit has been opened, the bottle 400 is inserted into the sheath 420. Then, the bottle drive unit is closed, and the arm 240 is moved to a predetermined limit position.

Figure 8:
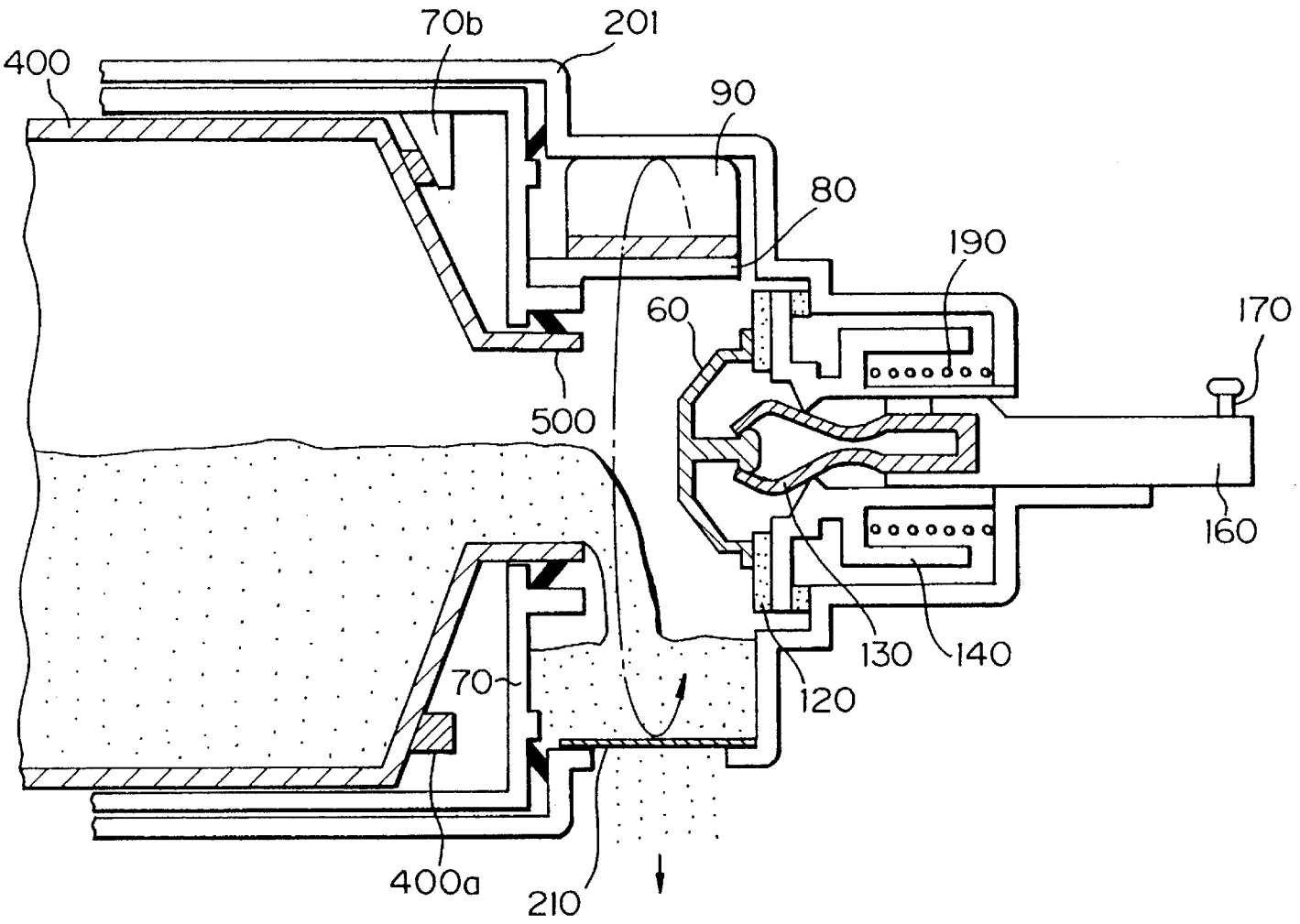
FIG. 8 is a section demonstrating how toner flows out of the container shown in FIG. 7 into container holding means.

The toner is replenished from the bottle 400, as follows. As shown in FIG. 5, the motor 100 is rotated in a direction D for replenishing the toner. The rotation of the motor 100 is transferred to the gears 300*a* and 300*b* via the worm gear 200. The gear 300*b*, rotating in a direction E, causes the bottle retainer member 70 to rotated in a direction F via the bottle drive gear 70*a*. As a result, the bottle 400 is rotated in the direction F. As shown in FIG. 8, while the bottle 400 is in rotation, the toner flows out via the mouth 500 and accumulates on the bottle receiver 201. At the same time, the pusher member 90 affixed to the rib 80 of the retainer member 70 slides on the inner wall of the receiver 201. When the pusher member 90 slides on the elastic member 210, it pushes out the toner through the apertures of the member 210. As a result, a predetermined amount of toner is replenished into a developing section 330*b* included in the developing unit 330 via the toner inlet 330*a*. In this manner, because the toner is forced into the toner inlet 330*a* by the elastic member 210 only when the bottle 400 is in rotation, the toner concentration in the developing section 330 is maintained constant.

Figure 9:
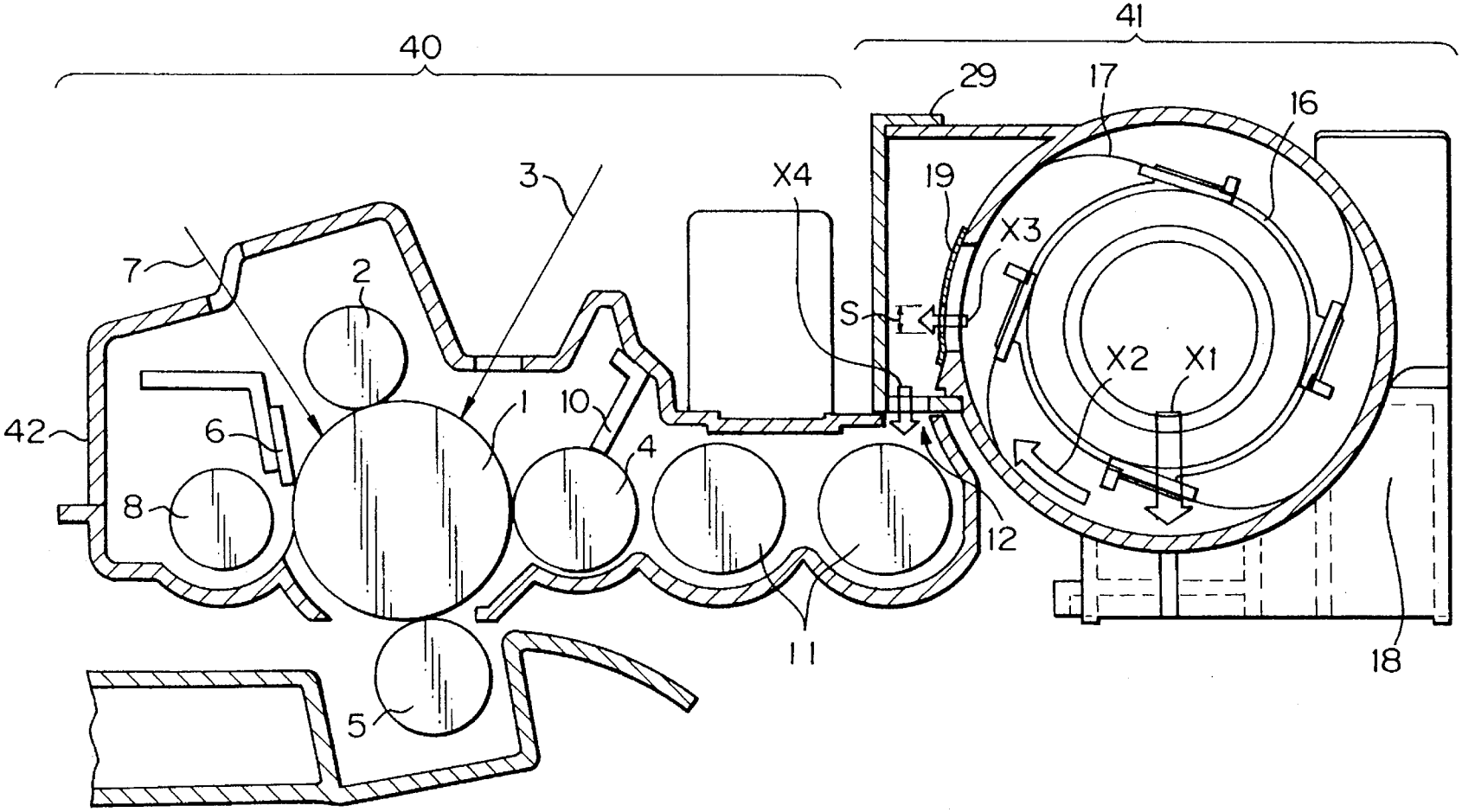
FIG. 9 is a section showing an image forming apparatus implemented by still another alternative embodiment of the present invention.
Figure 11:
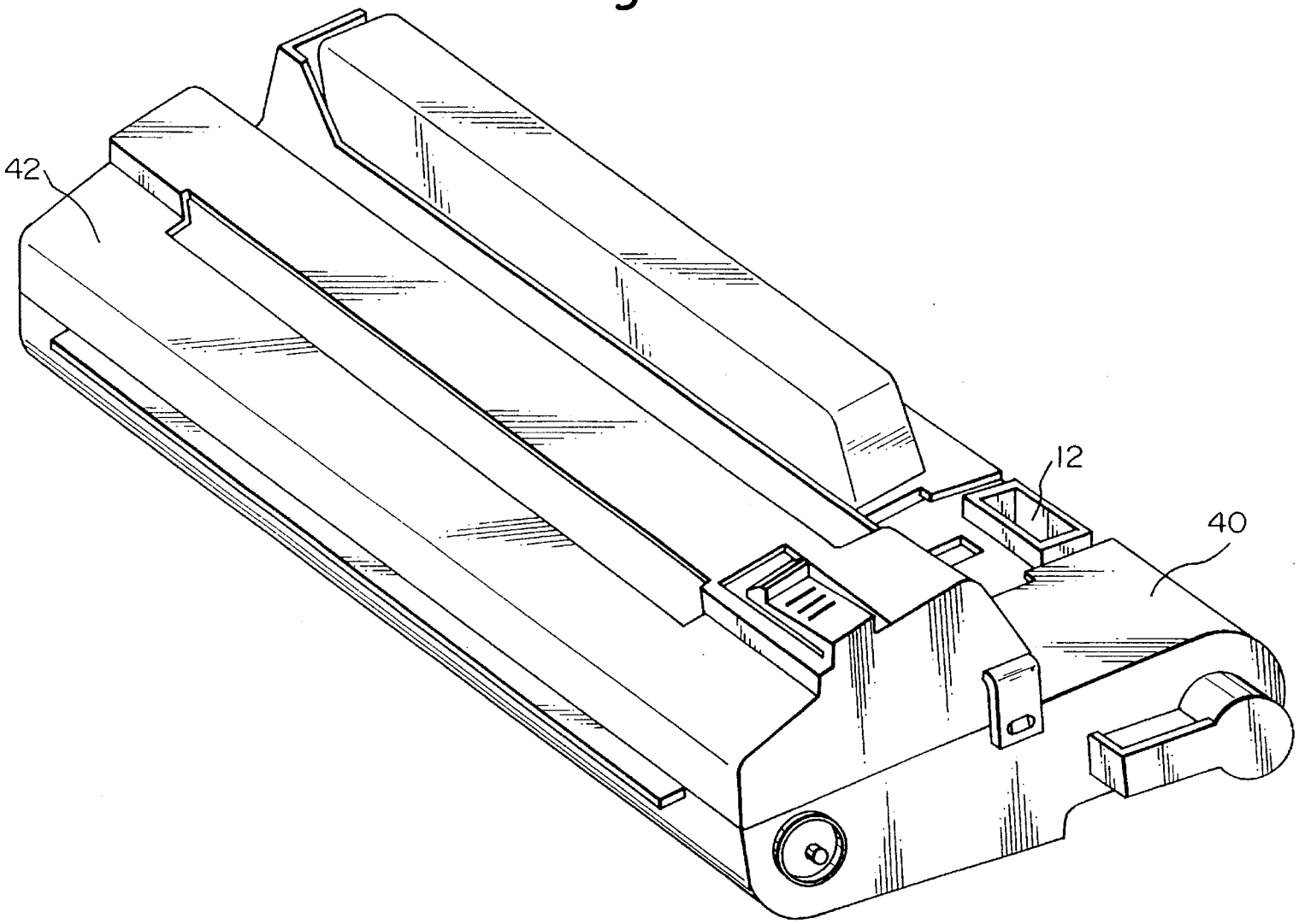
FIG. 11 is a perspective view of the process cartridge shown in FIG. 10.

FIG. 9 shows another alternative embodiment of the present invention together with an image forming apparatus implemented thereby. As shown, the apparatus has a process cartridge 40 accommodating a photoconductive drum or image carrier 1. Arranged around the drum are a charge roller 2 for uniformly charging the surface of the drum 1, a discharging unit for issuing light 7 for discharging the surface of the drum 1, optics for issuing a laser beam 3 for electrostatically forming a latent image, a developing sleeve 4 for depositing toner on the latent image, a transfer roller 5 for transferring the resulting toner image to a sheet, a cleaning blade 6 for removing toner remaining on the drum 1 after image transfer, and a coil 8 for conveying the toner removed by the blade 6 to a recycle toner conveying portion, not shown. The developing sleeve 4 has a stationary shaft accommodating a five-pole magnet therein. The sleeve 4 is surrounded by a nonmagnetic tubular member. A doctor blade 10 for regulating the amount of toner and screws 11 for circulating and agitating a developer are arranged around the sleeve 4. The drum 1, charge roller 2 and sleeve 4, as well as their associated members, are disposed in a case 42. FIG. 11 shows the process cartridge 40 in an external perspective view.

As shown in FIG. 9, a toner replenishing device 41 is mounted to a toner inlet portion 12 included in the process cartridge 40. The replenishing device 4 1 is supported by a seat 18 and a cover 29 which guides toner to the toner inlet portion 12. A bottle retainer member 16 is disposed in the replenishing device 41 and rotatable in a direction indicated by an arrow X2. A plurality of pusher members 17 are affixed to the outer periphery of the retainer member 16.

Figure 10:
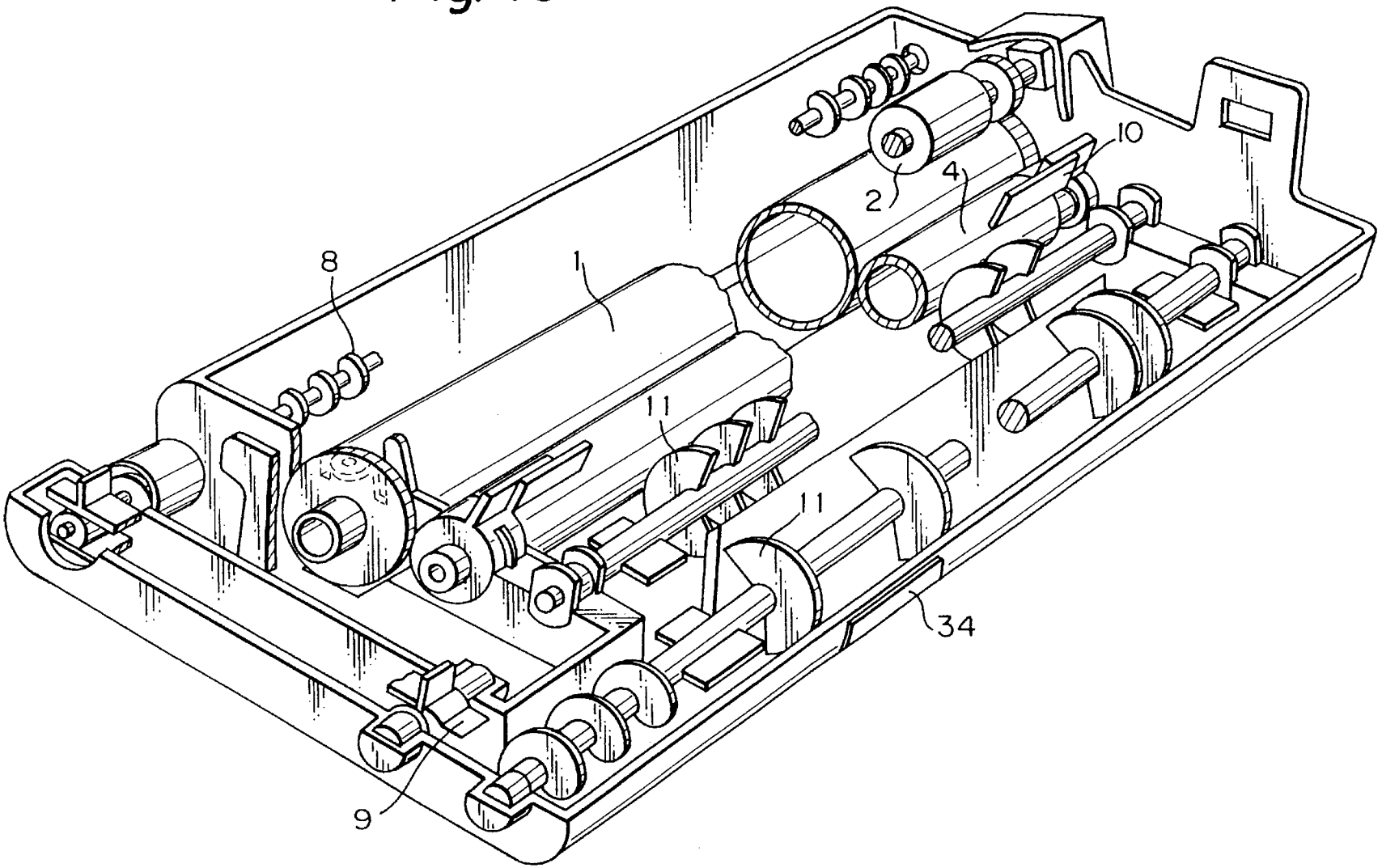
FIG. 10 is a perspective view showing the internal arrangement of a process cartridge included in the embodiment of FIG. 9.

In operation, the drum 1 is discharged by the light 7 such that the surface potential thereof is averaged to a reference potential ranging from 0 V to 150 V. Then, the surface of the drum 1 is charged by the charge roller 2 to a potential of about −1,100 V. Subsequently, surface potentials ranging from 0 V to −290 V are deposited on the portion of the drum 1 illuminated by the laser beam 3, i.e., an image portion. Because a bias of about −800 V is applied to the developing sleeve 4, the toner is transferred from the sleeve 4 to the image portion of the drum 1. While the drum 1 carrying the resulting toner image thereon is in rotation, a sheet is fed from a sheet feed section, not shown, such that the leading edge thereof meets the leading edge of the toner image at the transfer roller 5. As a result, the toner image is transferred from the drum 1 to the sheet. Then, the sheet has the toner fixed thereon by heat and pressure at a fixing station, not shown. The sheet with the fixed image is driven out of the apparatus as a copy. The toner remaining on the drum 1 after the image transfer is removed by the blade 6. Then, the surface of the drum 1 is discharged by the light 7 and prepared for the next image formation thereby. This is the basic operation of the apparatus. The toner collected by the blade 6 is conveyed to the previously mentioned recycle toner conveying portion by the coil 8. At the conveying portion, a recycle belt 9 (see FIG. 10)conveys the toner to the agitating portion of the developing device.

In the process cartridge 40, the developer moves on the sleeve 4 which is in rotation. The developer is a mixture of iron particles and toner particles, i.e., a two-ingredient type developer. The screws 11 agitate and circulate the developer. As a result, the toner is charged and deposited on the carrier. The carrier conveys the toner toward the surface of the drum 1 therewith. The toner is electrostatically transferred to the drum 1. While the carrier is repeatedly circulated in the cartridge 40, the toner is sequentially consumed due to the deposition on latent images and must be adequately replenished. The doctor blade 10 regulates the amount of the developer and thereby allows the developer to be supplied to the drum 1 in a constant amount.

Figure 12:
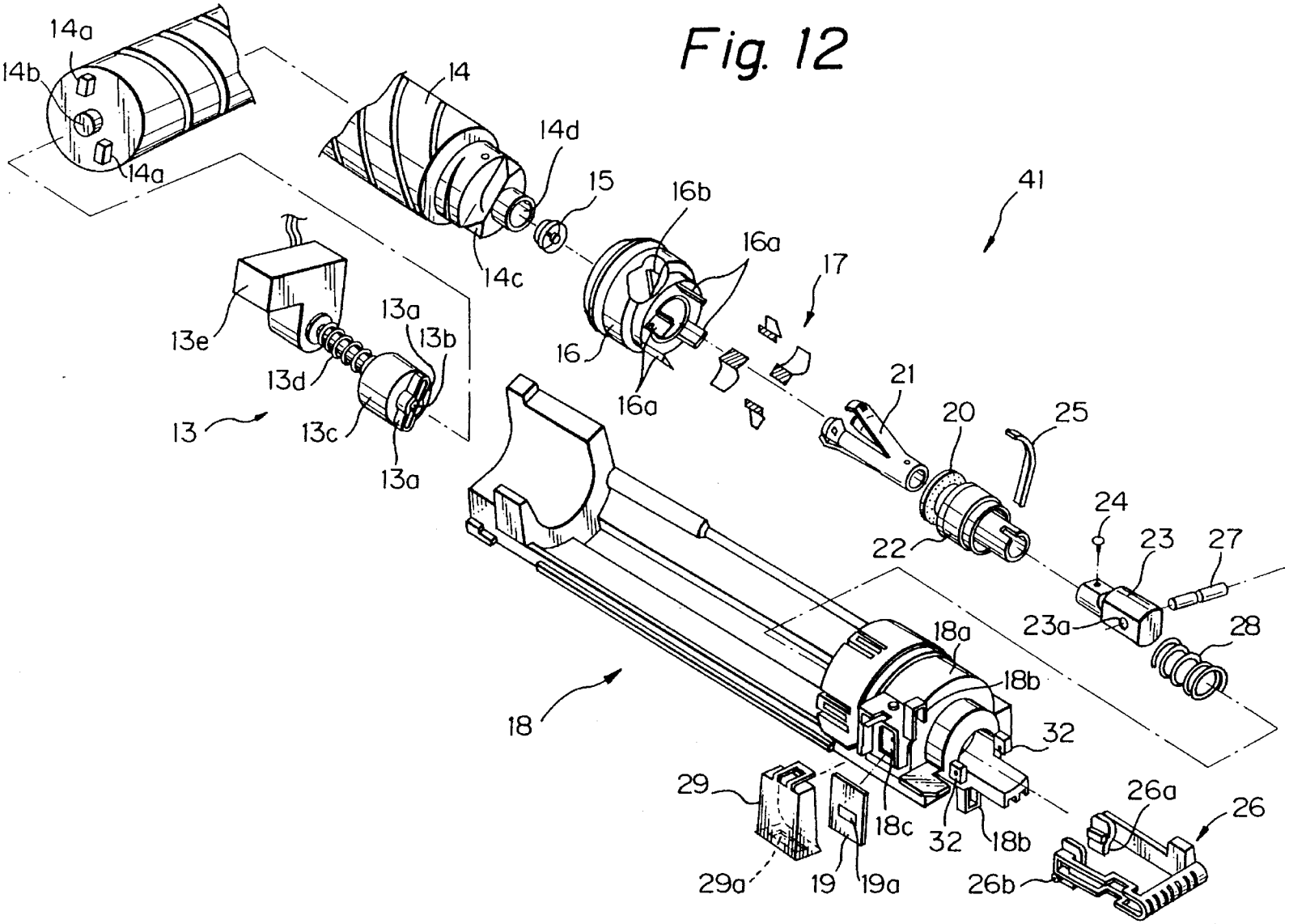
FIG. 12 is an exploded perspective view showing constituent parts included in the embodiment of FIG. 9.

The replenishing device 41 will be described in detail. As shown in FIG. 12, the replenishing device 41 is driven by drive means 13 made up of a joint 13*c*, a spring 13*d*, a motor 13*e*, and a case accommodating a shaft. The drive means 13 is mounted on a rear panel 31 (see FIG. 13) forming a part of the apparatus body. A toner container or bottle 14 has lugs 14*a* and 14*b* on the bottom thereof. The lug 14*b* is received in a recess 13*b* formed in the joint 13*c*, thereby supporting the bottom of the bottle 14. The lug 14*a* abuts against a lug 13*a* formed on the joint 13*c* and causes the bottle 14 to rotate. A bottle or container retainer member 16 retains the head portion of the bottle 14. A pusher member 17 is made of MYLAR, rubber or similar elastic member. In the illustrative embodiment, four pusher members 17 are each adhered by, e.g., a two-sided adhesive tape to one of ribs 16*a* formed integrally with the retainer member 16. The ribs 16*a* play the role of an agitator.

A spiral ridge is formed on the inner periphery of the bottle 14 such that it drives toner out of the bottle 14 via a mouth 14*d* when the bottle 14 is rotated. A cap 15 is fitted in the mouth 14*d* in order to prevent the toner from flowing out. A rib 16*b* is formed on the inner periphery of the retainer member 16. When the rib 16*b* abuts against a flat portion 14*c* provided on the head portion of the bottle 14, it allows the bottle 14 to rotate integrally with the retainer member 16.

The reference numerals 20 and 25 designate seal members. A collet chuck 21 selectively grips or releases the cap 15. The chuck 21 is received in a cylindrical case 22 and fastened to a shaft member 23 by a screw 24. A coil spring 28 constantly biases the chuck 21, case 22 and shaft member 23 toward the bottle 14. These constituents are held by a case, or holding means, 18*a* which is formed integrally with the seat 18. A handle 26 has a shaft portion 26*b* received in a bearing portion 32 included in the case 18*a*. The handle 16 is rotatable about the shah portion 26*b* in order to attach or detach the cap 15. A slide shah 27 is received in a hole 23*a* formed in the shaft member 23. The slide shaft 27 is held in contact with a cam portion 26*a* included in the handle 26. When the handle 26 is rotated about the shaft portion 26*b*, the slide shah 27 causes the chuck 21, case 22 and shah member 23 to slide away from the bottle 14.

An opening 18*c* is formed in the case 18*a* and communicates the toner outlet or mouth 14*d* of the bottle 14 to the toner inlet portion 12 (see FIG. 9) of the developing device 40. An elastic member 19 is adhered to the edges of the opening 18*c* by, e.g., a two-sided adhesive tape and implemented by MYLAR, rubber or similar elastic material. The elastic member 19 is formed with a rectangular slot 19*a* extending in the horizontal direction which is perpendicular to the direction in which the pusher members 17 are movable. The area of the slot 19*a*, i.e., the length (horizontal) and width S (direction in which the pusher members 17 are movable; see FIG. 9) are adequately selected in order to replenish the toner in an adequate amount. In the illustrative embodiment, the pusher members 17 are adhered to the ribs 16*a* such that they are capable of protruding about 1 mm from the slot 19*a*. A cover 29 guides the toner flowing out of the slot 19*a* to the toner inlet portion 12. An opening 29*a* is formed in the bottom of the cover 29 and aligned with the toner inlet portion 12.

Figure 13:
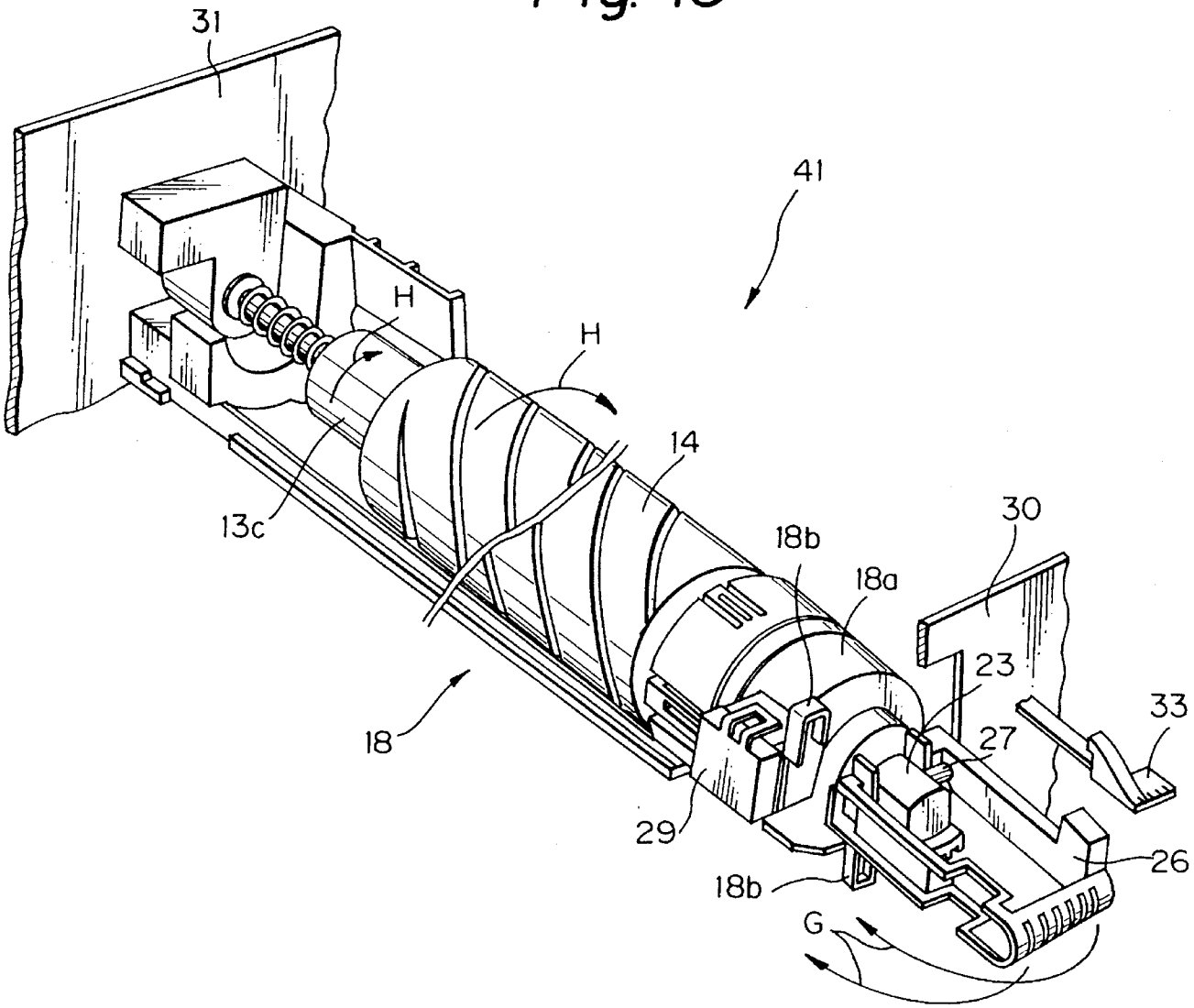
FIG. 13 is a perspective view of the embodiment of FIG. 9.

As shown in FIG. 13, the replenishing device 41 is held by a guide plate, not shown, mounted to a front panel 30 and the previously mentioned rear panel of the apparatus body. The seat 18 has a hole 18*b* to mate with a positioning pin, not shown, studded on the front panel 30. A stop 33 is studded on the guide plate in order to prevent the replenishing device 41 from being dislocated. In this configuration, the replenishing device 41 is made up of a mechanical or structural portion including the case 18*a* and bottle retainer member 16, the bottle 14 removably mounted to the mechanical portion, and the drive portion 13.

Figure 14:
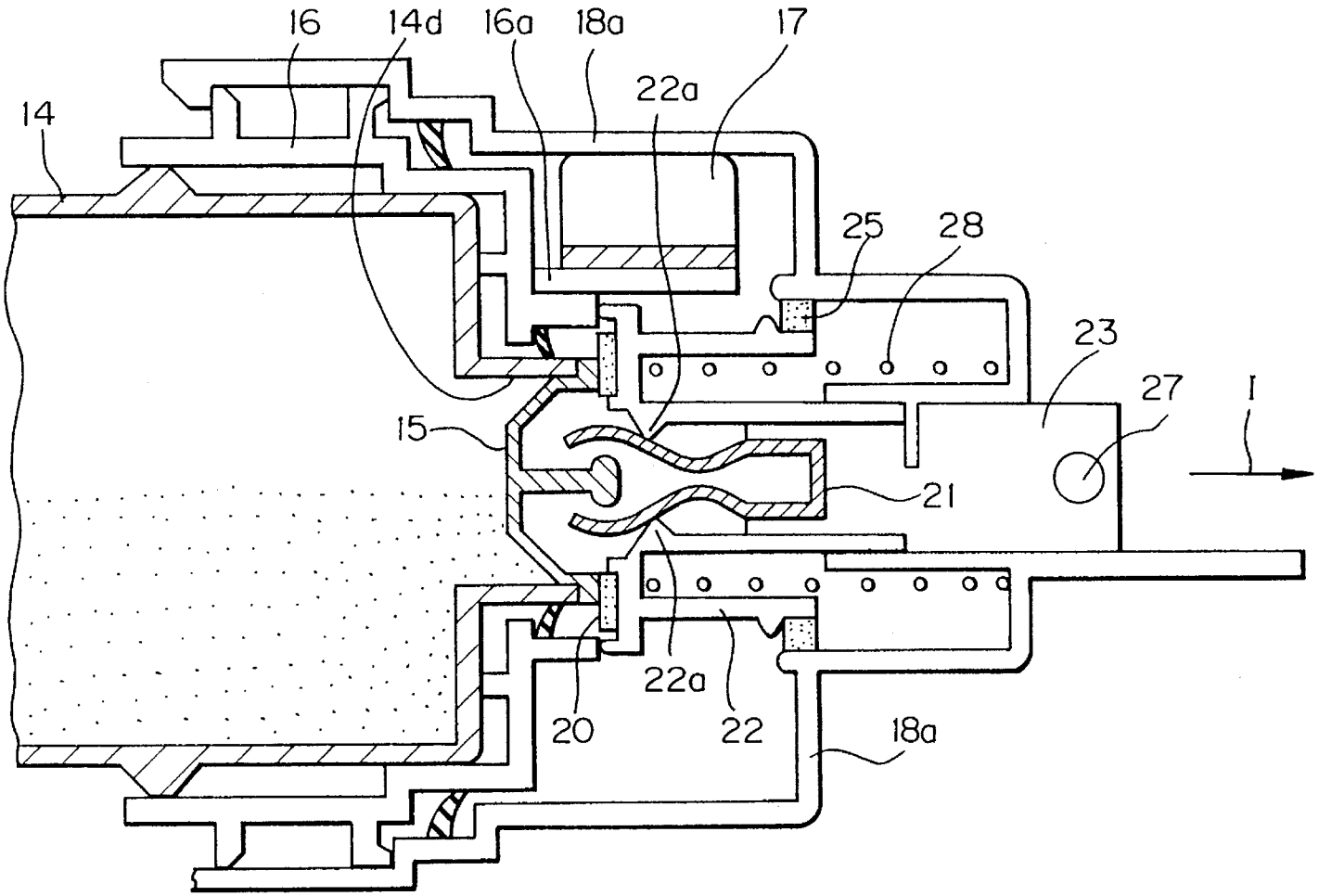
FIG. 14 is a section showing a toner container included in the embodiment of FIG. 9 and mounted to a toner replenishing device.
Figure 15:
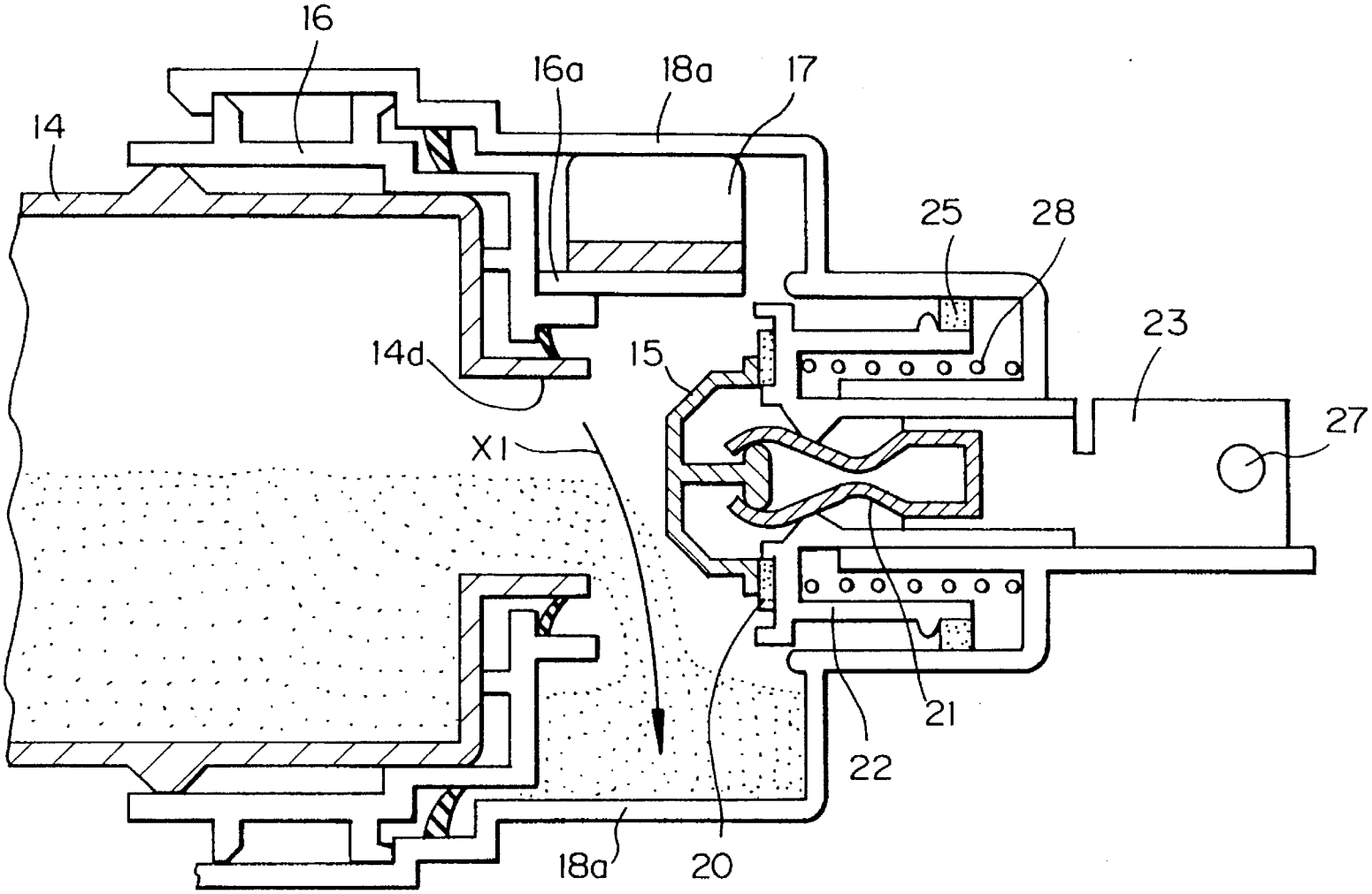
FIG. 15 is a section demonstrating how toner flows out of the toner container shown in FIG. 14 into container holding means.

A procedure for setting the replenishing device 41 on the apparatus body will be described. First, as shown in FIG. 13, the bottle 14 filled with toner is laid on the seat 18 while having its bottom and head respectively engaged with the joint 13*c* and retainer member 16. Then, the handle 26 is rotated downward, as indicated by an arrow G. As a result, the cam portion 26*a* pulls the slide shaft 27 and, therefore, the shaft 23 in a direction I shown in FIG. 14. This causes the chuck 21 to abut against an annular projection 22*a* included in the case 22. The chuck 21, therefore, begins to close while gripping the cap 15. As the shaft 23 is further moved in the direction I, the chuck 21 removes the cap 15 from the bottle 14, as shown in FIG. 15. Consequently, the toner flows out of the bottle 14 into the case 18*a* (except when the amount of toner remaining in the bottom 14 is small). By the above procedure, the replenishing device 41 is fully set in a predetermined condition.

The toner is replenished from the bottle 14 by the following procedure. A permeability sensor 34 (FIG. 10) senses the toner concentration of the developer existing in the process cartridge 40. When the toner concentration falls below a reference value, as determined by the sensor 34, the drive section 13 shown in FIGS. 12 and 13 are operated to rotate the joint 13*c* in a direction H shown in FIG. 13. As a result, the joint 13*c* abuts against the lug 14*a* of the bottle 14 and causes the bottle 14 to rotate. This causes the toner to flow out of the bottle 14 in a direction X1 shown in FIGS. 15 and 9 and accumulate on the case 18*a*. At the same time, the rotation of the bottle 14 is transmitted to the retainer member 16 via the rib 16*b*. Hence, the pusher members 17 slide on the inner periphery of the case 18*a* while raking the toner in the case 18*a* upward, as indicated by an arrow X2 in FIG. 9. When any one of the pusher members 17 arrive at the slot 19*a* of the elastic member 19, it pushes out the toner through the slot 19*a*, as indicated by an arrow X3. In addition, when the pusher member 17 protrudes from the slot 19*a*, it pushes out the toner deposited on the edges of the slot 19*a* and those of the opening 18*c*. The toner falls in the cover 29 and advances from the opening 29*a* of the cover 29 to the process cartridge 40 via the toner inlet portion 12, as indicated by an arrow X4 in FIG. 9. In this manner, because the toner is driven to the toner inlet portion 12 by the elastic member 19 only when the bottle 14 is in rotation, it is replenished into the cartridge 40 in a constant amount at all times. As a result, the toner concentration of the developer in the cartridge 40 is maintained constant.

Modified forms of the elastic member 19 will be described hereinafter. The elastic member 19 may be formed with the apertures 50 (FIG. 2) in place of the slot 19*a*. However, because the member 19 is adhered to the outer periphery of the case 18*a*, a step is formed between the member 19 and the case 18*a* at the opening 18*c* due to the thickness of the case 18*a*. The step prevents the pusher members 17 from contacting the apertures 50. Hence, when the toner is of the kind which is easy to accumulate, it is apt to accumulate in the vicinity of the step and stop up the apertures 50. This causes the amount of toner replenishment to sharply decrease and results in defective images.

Figure 16:
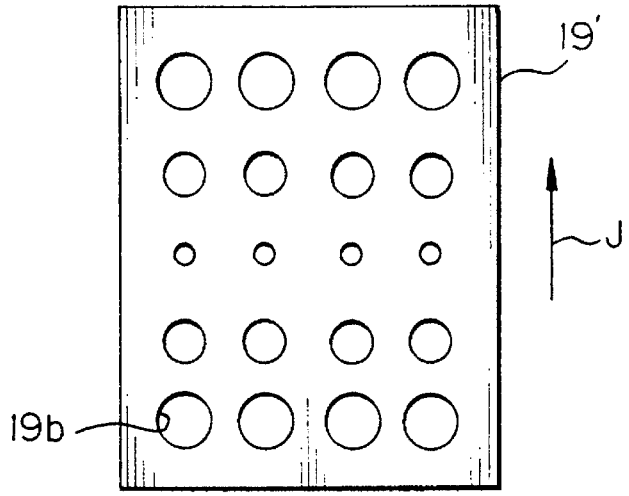
FIGS. 16, 17 and 18 are views each showing a particular modification of an elastic member included in the embodiment of FIG. 9.

In light of the above, as shown in FIG. 16, a modified elastic member 19' has apertures 19*b* the diameter of which is sequentially reduced from the opposite edes to the center of the member 19' in the up-and-down direction (direction of movement of the pusher members 17; arrow J). Stated another way, the diameter of the apertures 19*b* sequentially increases from the center to the opposite stepped portions. This allows the toner around the step to pass through the apertures 19*b* easily.

Figure 17:
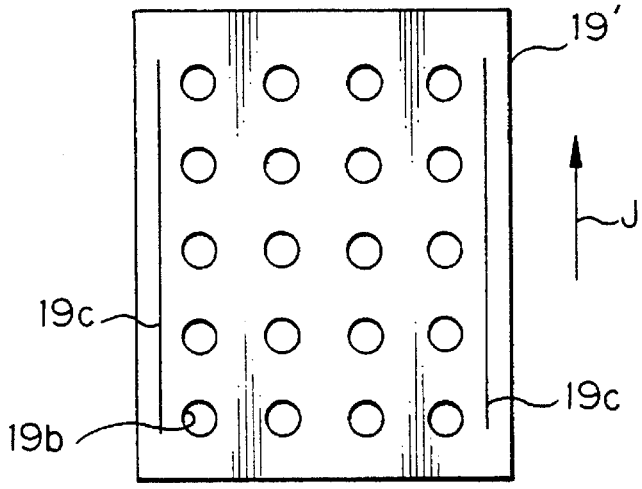

As shown in FIG. 17, another modified elastic member 19' is implemented by a film-like sheet and formed with apertures 19*b*. Cuts 19*c* are formed in the opposite edge portions of the sheet 19' in the right-and-left direction, and each extends in the direction of movement of the pusher members 17 (arrow J). The cuts 19*c* extend over a length equal to or slightly smaller than the length of the opening 18*c* of the case 18*a*. When any one of the pusher members 17 contacts and pushes the apertures 17*b*, the cuts 19*c* cause the member 19' to vibrate. As a result, the toner deposited on the member 19' is shaken off.

Figure 18:
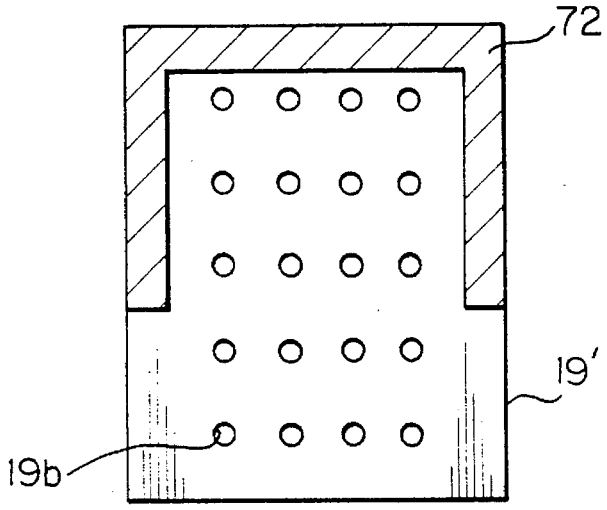
Figure 19:
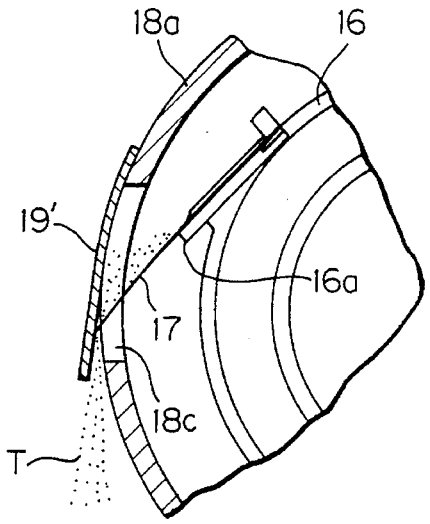
FIG. 19 demonstrates the movement of the elastic member.

As shown in FIG. 18, still another modified elastic member 19' is also implemented by a film-like sheet and formed with apertures 19'. The sheet 19' is adhered to the case 18*a* by two-sided adhesive tape 72 only at the top edge and the upper portions of the right and left edges contiguous with the top edge, as indicated by hatching. The bottom edge and the lower portions of the right and left edges are not adhered to the case 18*a*. When any one of the pusher members 17 contacts the sheet 19', it urges the lower portion of the sheet 19' away from the case 18*a*, as shown in FIG. 19. When the pusher member 17 in rotation moves away from the boundary between the wall of the case 18*a* and the opening 18*c*, it hits against the apertures 19*b* and thereby shakes off the toner T deposited on the sheet 19'. As a result, the toner T flows out to the toner inlet portion 12 through the gap between the lower portion of the sheet 19' and the case 18*a*.

In the modification shown in FIG. 18, the toner is replenished not only through the apertures 19*b* but also through the gap between the lower portion of the elastic member 19' and the case 18*a*, as stated above. By adequately selecting the thickness of the pusher members 17 and the amount of contact thereof with the member 19' or adequately selecting the elasticity of the pusher members 17 or that of the member 19', it is possible to regulate the amount of toner to be replenished through the gap between the lower portion of the member 19' and the case 18*a*. Hence, the toner can be replenished in a controlled amount despite the above gap.

It is to be note that any one of the modifications shown in FIGS. 16–18 is also applicable to the holed sheet 51 shown in FIG. 1.

In summary, it will be seen that the present invention provides a toner replenishing device having various unprecedented advantages, as enumerated below.

(1) A plurality of apertures are concentratedly positioned at one end portion of a toner storing section with respect to the widthwise direction of a developing device. This reduces the size of a mechanism for screening the apertures, or toner supply openings, and thereby enhances a screening effect. In addition, the cost is reduced because the apertures do not need high accuracy.

(2) When the apertures are replaced with a slot, the free end of an agitator is capable of protruding from the slot. This prevents toner from depositing on the apertures and thereby guarantees stable toner replenishment.

(3) Holding means for holding a toner container is formed with an opening for delivering the toner from the mouth of the container to a toner inlet portion. An elastic member formed with a slot covers the above opening. Hence, most of the toner flown out of the container can b e temporarily accumulated in the holding means. In this sense, the holding means plays the role of a conventional toner hopper at the same time. This eliminates the need for a toner hopper and thereby provides the device with a compact configuration while noticeably reducing the cost.

(4) The toner container is held by a holding section which is rotatable integrally with the container. The holding section has an elastic pusher member corresponding in position to the elastic member. During the course of rotation, the pusher member slides on the elastic member while pushing out the toner. Hence, the toner can be replenished into a developing section in a constant amount by a simple arrangement. At the same time, the device is provided with a compact configuration while the cost thereof is noticeably reduced. When the toner container runs out of toner, it should only be replaced alone; the holding section is repeatedly usable. This also reduces the cost to a significant degree.

(5) Because the device has a plurality of pusher members, the number of times that the free edge of the elastic member moves over the slot for a single rotation increases. It is, therefore, possible to reduce the width of the slot in order to replenish a small amount of toner a number of times. This is more desirable than replenishing a great amount of toner only once in respect of irregularities in the toner concentration in the developing device. In addition, because the toner is replenished a plurality of times for a single rotation, it can be replenished into the developing device by a short time of drive.

(6) An elastic member formed with a plurality of apertures is adhered to the edges of the opening. This also achieves the above advantage (3).

(7) The diameter of the apertures sequentially decreases from the opposite edges to the center of the elastic member in the direction in which the pusher members are movable. The device, therefore, prevents the toner from depositing or accumulating in the vicinity of the apertures or the opening and thereby insures stable toner replenishment, while achieving the above advantages (1) and (3) at the same time.

(8) The apertures are formed in a film-like sheet together with cuts. This also achieves the above advantage (7).

(9) The apertures are formed in a film-like sheet which is only partly adhered to the edges of the opening. The part of the sheet not adhered to the edges of the opening is movable away from the edges. This also achieves the above advantage (7).

(10) The device is made up of a mechanical or structural portion and the toner container or bottle to be removably mounted thereto. Hence, only the bottle should be replaced when it runs out of toner, while the mechanical portion is repeatedly usable. In addition, the used bottle may be sealed by a seal member in order to prevent the toner from flying about in the event of replacement.

Various modifications will become possible for those skilled in the art after receiving the teachings of the present disclosure without departing from the scope thereof.

What is claimed is:

1. A device for replenishing toner to a developing section included in a developing device, and removably mounted to said developing device, said device comprising:

a toner storing section accommodating an agitator, and formed with an opening at one end portion with respect to a widthwise direction of the developing device;

an elastic member covering said opening, and formed with a holed portion for replenishing the toner driven by said agitator from said toner storing section to the developing section; and a mechanism for closing said holed portion when said device is to be removed from the developing device.

2. A device as claimed in claim 1, wherein said holed portion of said elastic member comprises a plurality of apertures.

3. A device as claimed in claim 1, wherein said holed portion of said elastic member comprises a slot positioned such that a free edge of said agitator is capable of protruding from said slot.

4. A device as claimed in claim 1, wherein said holed portion of said elastic member comprises cuts formed in a film-like sheet.

5. A device as claimed in claim 4, wherein a part of said film-like sheet is adhered to a part of edges of said opening of said toner storing section while the other part of said film-like sheet is movable away from the other part of said edges said opening.

6. A device for replenishing toner to a developing section included in a developing device, comprising:

a toner container comprising a hollow cylindrical body formed with a toner outlet at a center of one end thereof;

holding means for holding said toner container in a substantially horizontal position such that the toner is capable of being fed from said toner outlet to a toner inlet portion of the developing device; and drive means for causing said toner container held by said holding means to rotate about an axis of said hollow cylindrical body;

wherein said holding means is formed with an opening for delivering the toner flowing out of said toner container via said toner outlet to the toner inlet portion, and wherein an elastic member having a holed portion covers said opening.

7. A device as claimed in claim 6, wherein said holed portion comprises a slot.

8. A device as claimed in claim 6, wherein said toner container is held by a holding portion rotatable integrally with said toner container, and wherein elastic pushing means is positioned on said holding section at a position corresponding to said elastic member, and for pushing out the toner while sliding on said elastic member while in rotation.

9. A device as claimed in claim 8, wherein said pushing means comprises a plurality of pusher members.

10. A device as claimed in claim 8, wherein said holed portion of said elastic member comprises a plurality of apertures a diameter of which is greater at opposite end portions of said elastic member than at a center with respect to a direction in which said pushing means is movable.

11. A device as claimed in claim 6, wherein said holed portion of said elastic member comprises cuts formed in a film-like sheet.

12. A device as claimed in claim 11, wherein a part of said film-like sheet is adhered to edges of said opening of said holding means while the other part of said film-like sheet is movable away from the other part of said edges of said opening.

* * * * *